US005111008A

United States Patent [19]

Oster

[11] Patent Number: 5,111,008

[45] Date of Patent: May 5, 1992

[54] EFFECTIVE ARC STACK/EFFICIENT CONTACT CARRIER

[75] Inventor: Clark L. Oster, Cedar Rapids, Iowa

[73] Assignee: Square D Company, Palatine, Ill.

[21] Appl. No.: 581,853

[22] Filed: Sep. 13, 1990

[51] Int. Cl.[5] ..... H01H 33/10; H01H 33/18

[52] U.S. Cl. ..... 200/144 R; 200/147 R; 200/147 B

[58] Field of Search ..... 200/144 R, 144 C, 147 R, 200/147 A, 147 B, 304, 305; 335/201

[56] References Cited

U.S. PATENT DOCUMENTS

| | | | |
|---|---|---|---|
| 2,242,905 | 5/1941 | Dickinson et al. | 200/147 |
| 3,248,505 | 4/1966 | Mayer | 200/144 R |
| 3,997,746 | 12/1976 | Harper et al. | 200/144 R |
| 4,072,916 | 2/1978 | Kussy | 335/195 X |
| 4,158,827 | 6/1979 | Bratkowski et al. | 335/195 X |
| 4,532,391 | 7/1985 | Bernt | 200/144 B |
| 4,620,074 | 10/1986 | Paul et al. | 200/144 B |
| 4,654,490 | 3/1987 | Leone et al. | 200/147 R |

*Primary Examiner*—J. R. Scott

*Attorney, Agent, or Firm*—Larry I. Golden; Jose W. Jimenez

[57] ABSTRACT

A circuit breaker (51) includes an arc stack of metal plates (52), each of which is disposed parallel to the movement of the contact arm (12), whereby lug strikes which may pass through the vent holes (32) in the housing (16) to the lug (18) are avoided. The arrangement of the metal plates (52) provides protection from such unintended lug strikes without requiring the use of additional parts (e.g., barriers, insulators, and deflectors). A contact arm (12) is provided that is light in mass, but which is still strong enough to resist bending caused by the contact blow off loop forces which occur during fault conditions. Contact arms (12) which have I-beam construction, as well as hollow cylindrical and hollow polygonal construction are capable of carrying currents found in intermediate range circuit breakers; however, they are lighter in mass than solid contact arms and thereby enable faster contact separation and reduced arcing currents.

11 Claims, 4 Drawing Sheets

EFFECTIVE ARC STACK/EFFICIENT CONTACT CARRIER

BACKGROUND OF THE INVENTION

1. Field of the Invention

The present invention generally relates to improved devices within electric circuit breakers for avoiding unintended arc discharges which strike the external lug, and more particularly to devices which employ a plurality of spaced metal plates for dividing the arc into smaller segments. The present invention further relates to electric circuit breakers for service in intermediate size circuits having voltages of up to 600 volts, normal currents of up to 1,000 amperes and short circuit currents of from 10,000 to 200,000 amperes.

2. Description of the Prior Art

Circuit breakers in this intermediate range typically displace from 100 to 600 cubic inches. They must shut off within about 4 milliseconds in order to avoid serious internal damage. Because of heat and electromagnetic characteristics these circuit breakers use tin plated aluminum lugs which provide good connections to both copper and aluminum wire and avoid the hysteresis problems associated with steel lugs. Because of the relatively large currents involved, the contact arm of these circuit breakers is subjected to strong repulsive "blow off loop" forces under fault conditions. This requires that the contact arm be strong. Additional repulsive force, less than that created by "blow off", is provided by the rapid expansion of gases ionized by the arcing current. Vent holes in the casing of the breaker allow for dissipation of pressure from these expanding gases.

Circuit breakers operate through physical separation of contact members. During separation, an electric arc develops between the contact members. It is well known in the art for circuit breakers in the intermediate range to use a plurality of spaced apart metal plates (an "arc stack") to divide the electric arc into segments. Prior art circuit breakers typically orient the arc stack so that the plane of the metal plates cuts across the line of separation between the separating contact members. As the contact members continue to separate, the arc tends to move through the arc stack and may reignite on the opposite side of the arc stack and strike the lug directly through vent openings in the casing rather than through the intended path formed by the successive plates in the arc stack and thence through a conductor to the lug. This unintended lug striking may occur because the electric potential of plates near a separating contact member may be such that the arc finds it easier to communicate to the lug through a vent between plates rather than through successive arc plates. At the voltages and currents characteristic of circuits using these breakers, this reignition of the arc and unintended striking of the lug is likely to destroy the circuit breaker.

In prior art circuit breakers, a variety of techniques have been employed for suppressing the arc within the arc stack and avoiding unintended lug strikes, including barriers, insulators, and deflectors. These additional parts complicate the fabrication process and increase costs. It would be advantageous to reduce the parts required to avoid unintended lug strikes, and simplify the fabrication process.

Traditional production methods for contact arms, such as stamping or extrusion, tend to produce rectangular cross sections which in these intermediate circuit breakers can be more massive than necessary in order to achieve adequate strength.

SUMMARY OF THE INVENTION

It is therefore an object of the present invention to provide an improved combination of arc suppressing components for use in intermediate size circuit breakers.

It is a further object of the present invention to prevent unintended lug strikes in intermediate size circuit breakers by means of relatively simple and economical components.

The present invention contemplates an arc stack of metal plates disposed generally parallel to the movement of the circuit breaker's contact arm, wherein the metal plate farthest from the contact arm is electrically connected to the lug, thereby providing a physical and electrical shield against unintended lug strikes, and wherein the contact arm has a low mass construction yet is still highly resistent to bending. The invention uses non traditional construction, such as I-beams, for the contact arms, thereby improving the ratio of strength to mass and reducing arcing current by allowing the contact arm to open faster. The parallel disposition of the arc stack reduces unintended arc strikes to the lug of the circuit breaker and, preferably, the arc plates cooperate with the breaker cover to seal off the gas path from the contact arm over the top of the plates. The present invention uses no extra parts and may use fewer parts if no stack sides are employed. The low mass and high strength of the contact arm permit interruption of the circuit more rapidly and with less arcing current. This combination of elements permits effective arc suppression with simpler and more economical construction.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
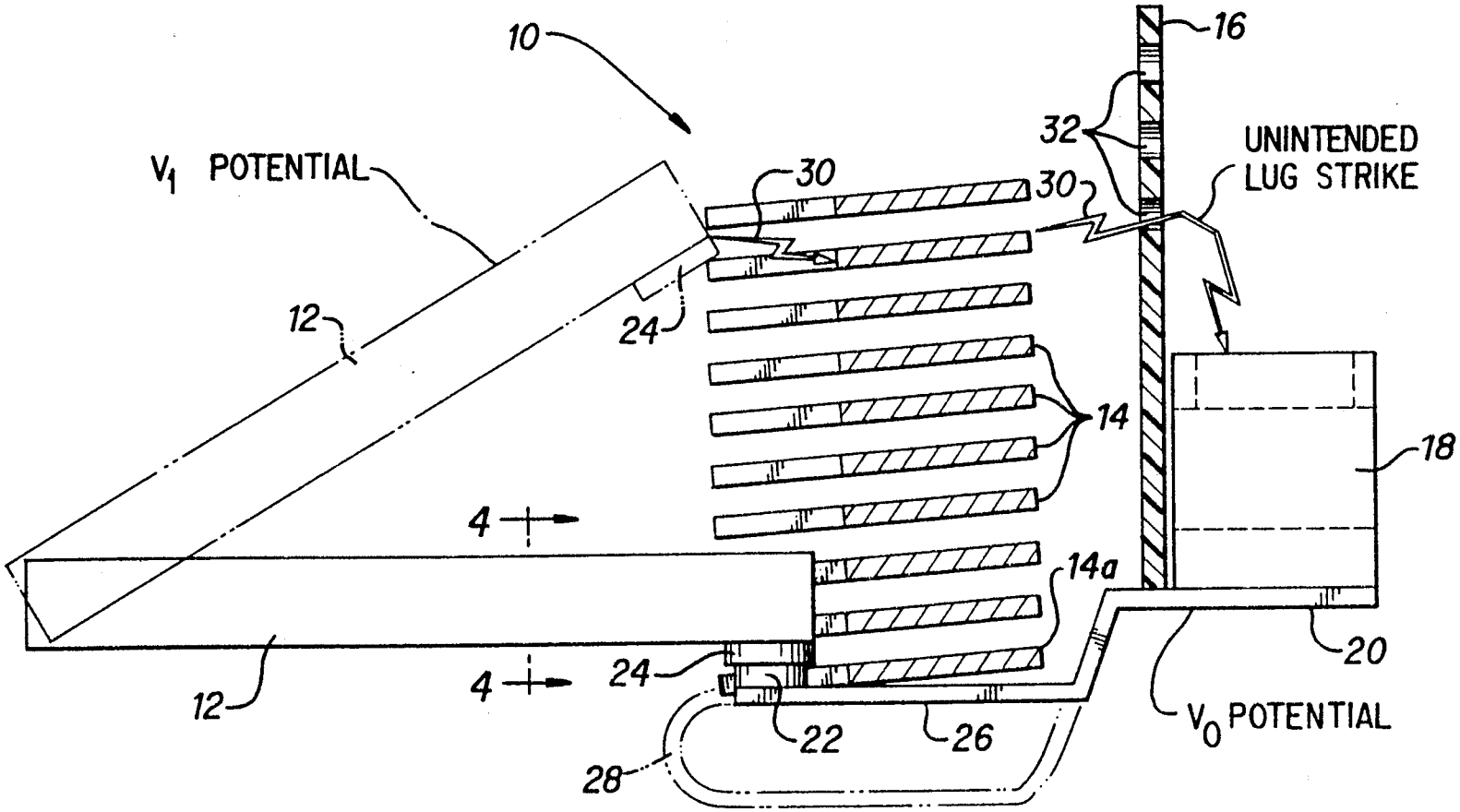
FIG. 1 PRIOR ART
FIG. 1 is a side view of an intermediate size circuit breaker according to the prior art.

Referring now to the drawings, and more particularly to FIG. 1, there is shown an example of a prior art intermediate size circuit breaker 10 comprised of a moveable contact arm 12 and an arc stack formed from a vertical array of horizontal metal plates 14 positioned inside a housing 16, a lug 18 positioned outside the housing 16, and a conductor 20 which passes through the housing 16 and electrically connects a fixed contact 22 positioned adjacent the bottom metal plate 14*a* in the arc stack to the lug 18. The bottom metal plate 14*a* may also be connected to the conductor 20. FIG. 1 shows that the conductor 20 can have a straight extension 26 which is oriented directly under the arc stack; however, it has become common practice to form conductor 20 with a bend 28 that first channels current away from the lug 18 and then loops back under the fixed contact 22 and thence to the lug 18. The bend 28 provides a "current blow off loop"defined by the rearward extension of the moveable contact arm 12, contacts 24 and 22, and the bend 28 section of conductor 20 which causes the contact arm 12 to open faster than a non-looped terminal as indicated by extension 26.

Figure 2:
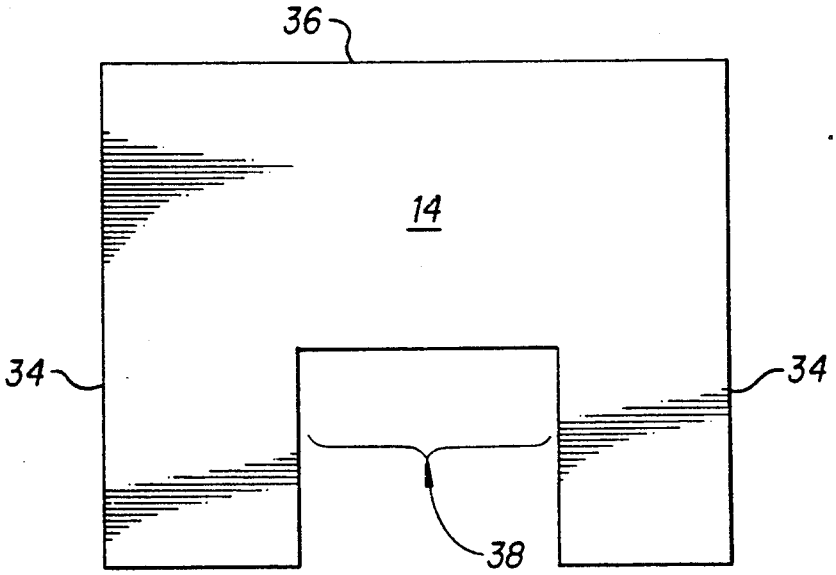
FIG. 2 PRIOR ART
FIG. 2 is a plan view of one of the arc plates used in the structure of FIG. 1.

The moveable contact arm 12 has a contact 24 on one end which is electrically connected to the fixed contact 22 when the moveable contact arm 12 is in its closed position. As the moveable contact arm 12 pivots to its open position, the metal plates 14 in the arc stack serve to divide the resulting electric arc 30 into segments since their horizontal orientation cuts across the line of separation between the moving contact 24 and the fixed contact 22. As best shown in FIG. 2, the metal plates 14 are generally U-shaped with arms 34 that project on either side of a main body 36. The space 38 between the arms 34 is the plane through which the free end of the moving contact arm 12 traverses. With reference back to FIG. 1, it is important for the free end of the moveable contact arm 12 to be in close proximity to the metal plates 14 in an intermediate sized circuit breaker so that the arc stack has a high interrupting capacity that can handle the higher voltages and larger currents used in intermediate sized circuit breakers. The arc 30 produced during contact 22 and 24 separation ignites a gas within the circuit breaker housing 16. Pressure from the ignited gas escapes the housing 16 through vent holes 32 which protect the circuit breaker 10 from blowing apart. One severe problem of prior art circuit breakers 10 is that, occasionally, the arc 30 may reignite on the opposite side of the arc stack and strike the lug 18 directly through one of the vent holes 32. At the voltages and currents characteristically used in intermediate sized circuit breakers 10, this unintended striking of the lug 18 is likely to destroy the circuit breaker 10.

Figure 3:
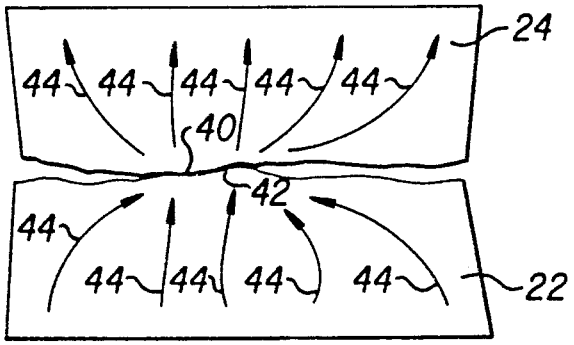
FIG. 3 PRIOR ART
FIG. 3 is an enlarged side view of the moving and fixed contacts shown in FIG. 1.

FIG. 3 shows an enlarged cross-sectional side view of the fixed contact 22 and moveable contact 24 which shows in an exaggerated manner that these contacts 22 and 24 are uneven at a microscopic level and meet only at a few points 40 and 42. When the circuit breaker is in use, all current, indicated generally by arrows 44, must flow through these contact points 40 and 42. Most current paths 44 do not move in a straight line across the contacts 22 and 24, but rather, they bend toward the contact points 40 and 42 and form tiny "contact blow off loops". During normal current conditions, the "contact blow off loop" forces tending to separate the contacts 22 and 24 are small and are easily overcome by a slight mechanical force, typically provided by a spring device, which holds the moveable contact arm 12 in place. During fault conditions, the large current dramatically increases the size of the "contact blow off loop" forces, effectively rendering a hammer-like blow to the moveable contact, causing rapid separation of the contacts. In most circuit breakers, fault conditions will also trigger a mechanical device to move the moveable contact arm 12 so as to separate the contacts 22 and 24; however, this mechanism operates relatively slowly to overcome the inertia of the moveable contact arm 12. Hence, for intermediate size circuit breakers, these "contact blow off loop" forces predominate in causing separation of the contacts 22 and 24.

Figure 4:
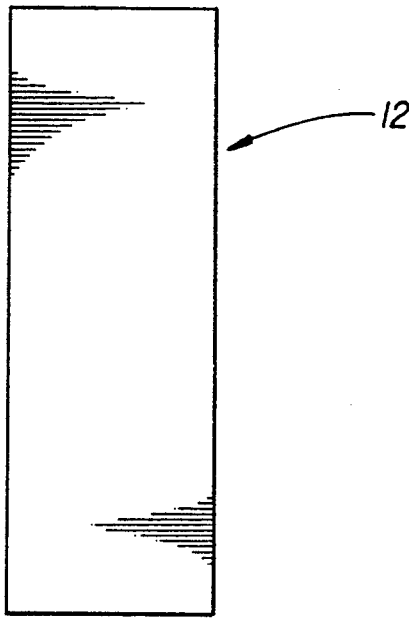
FIG. 4 PRIOR ART
FIG. 4 is an enlarged cross-sectional view of the prior art style contact arm taken along the line 4—4 in FIG. 1.

FIG. 4 shows that the moveable contact arm 12 of prior art circuit breakers 10 is rectangular in cross-section. The moveable contact arm 12 must be strong enough to withstand the hammer-like blow caused by the "contact blow off loop" forces during fault conditions. It has been found that the rectangular cross-section of prior art moveable contact arms, which is produced by stamping or extrusion, is much larger than necessary to carry the currents involved since its size is dictated by the necessity of achieving sufficient strength. The excess mass included in the moveable contact arm 12 increases the inertia of the arm, allows excess current to be carried therethrough, and reduces the speed of separation. These factors result in increasing the time and the amount of fault current provided before current cutoff.

Figure 5:
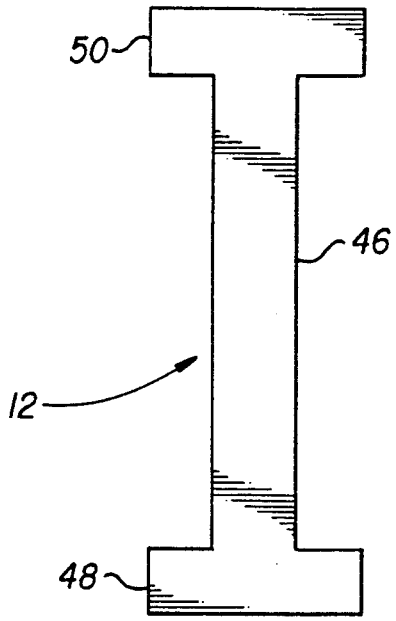
FIG. 5 is an enlarged cross-sectional view of a low mass contact arm of the present invention taken along the line 5—5 of FIG. 8 having I-beam construction.
Figure 6:
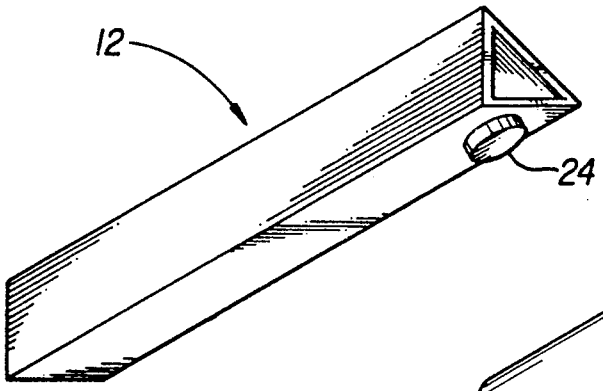
FIG. 6 is an enlarged cross-sectional view of a low mass contact arm of the present invention having a hollow polygonal cross-sectional construction.
Figure 7:
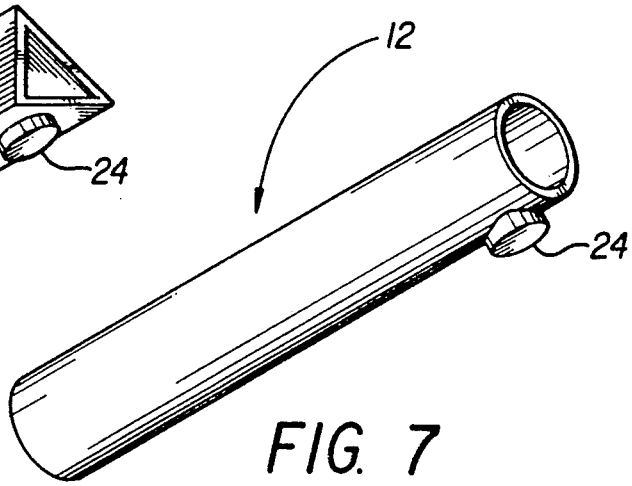
FIG. 7 is an enlarged isometric view of a low mass contact arm of the present invention having a hollow cylinder construction.

FIG. 5 shows one construction of the moveable contact arm 12 in which the excess mass and conductivity has been eliminated, yet where the strength of the moveable contact arm 12 has been maintained. In FIG. 5, the moveable contact arm 12 has an I-beam construction where, preferably, the long rectangular interior element 46 is capped at both ends with shorter rectangular elements 48 and 50 and all the rectangular elements 46, 48, and 50 have the same thickness so they may be stamped from the same metal sheet. The steel I-beam is a traditional low mass, high strength construction material used for building bridges and large buildings. The inventors were the first to recognize that the low mass, high strength benefits of I-beams could and should be employed in very small circuit breaker elements which are typically stamped out or extruded. In addition, to providing low mass and high strength, a moveable contact arm having I-beam construction also has reduced electrical conductivity which aids in voltage build up. Similar reductions in the ratio of mass and current carrying capacity to strength can be achieved by designs such as those shown in FIGS. 6 and 7 where the moveable contact arm 12 may have a hollow polygonal cross-section or a hollow cylindrical cross-section, respectively.

Figure 8:
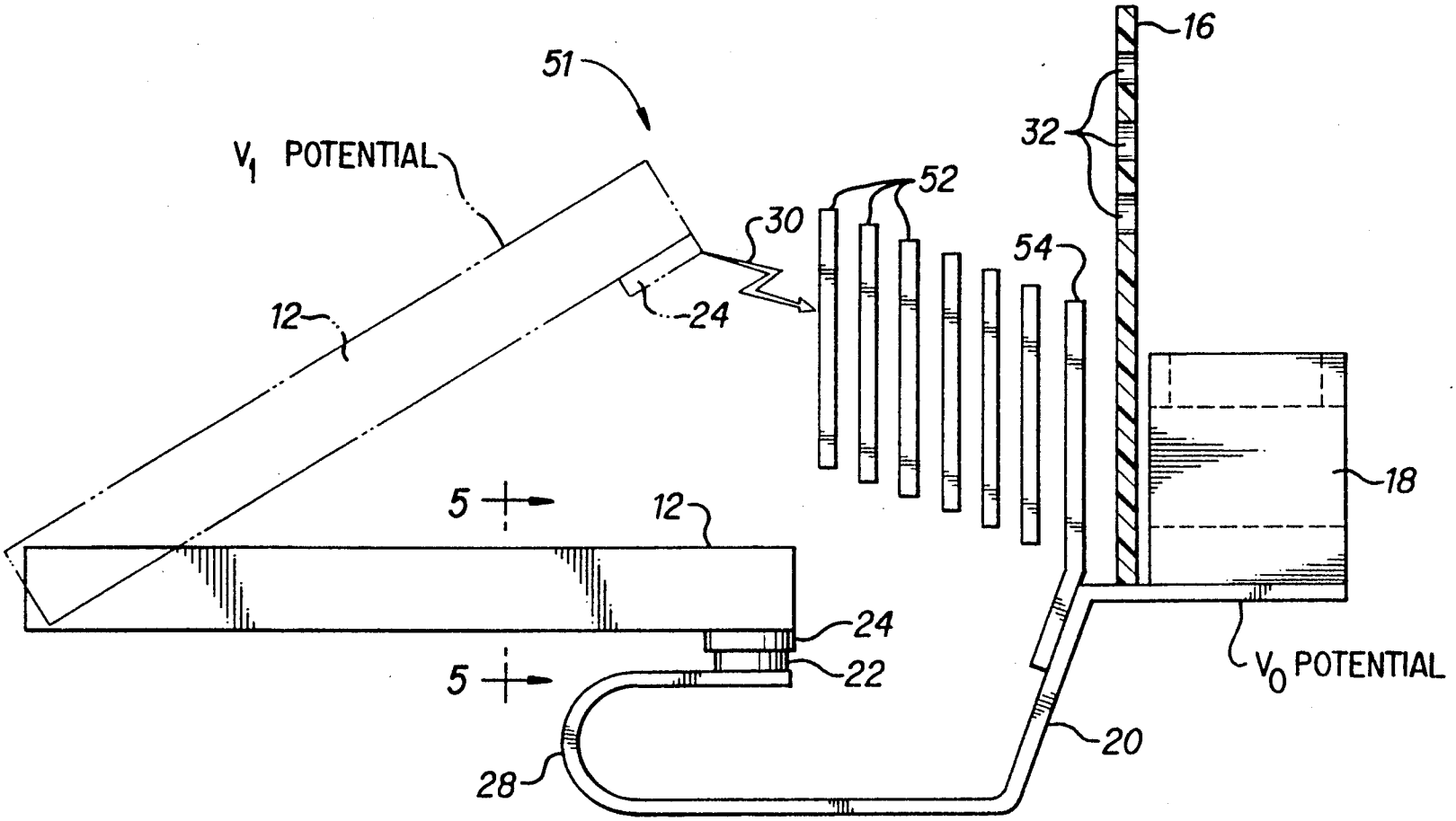
FIG. 8 is a side view of a circuit breaker according to the present invention having vertically arranged arc plates.

FIG. 8 shows the construction of a circuit breaker 51 according to the present invention wherein like elements to those shown in FIG. 1 retain the same numeric identification, i.e., moveable contact arm 12 in FIG. 1 is moveable contact arm 12 in FIG. 8. The principal difference between the present invention and that shown as the prior art for intermediate sized circuit breakers is that the metal plates 52 in the present invention are vertically as opposed to horizontally oriented and the arc stack formed from the metal plates 52 is generally horizontal as opposed to vertical. Hence, the line of contacts separation, i.e., the line drawn by the movement of contact 24 away from fixed contact 22, is roughly parallel to each of the metal plates 52. It is noted that the moveable contact arm 12 need not be pivotal, rather it could be designed to translate in a straight up and down movement. The rear metal plate 54 is electrically connected to the conductor 20. As discussed above in conjunction with FIGS. 5-7, it would be beneficial if the moveable contact arm 12 had a low mass, yet high strength construction.

In addition, as discussed above, because of the higher voltages which are typically handled by intermediate sized circuit breakers, the free end of the moveable contact arm 12 should be in close proximity to the arc stack of metal plates 52 (i.e., it should be close enough so that the arc 30 does not need to travel far to get to the arc stack). The arc stack serves the function of both interrupting the electric arc 30 and providing a cooling means for the energy produced by arcing.

Figure 9:
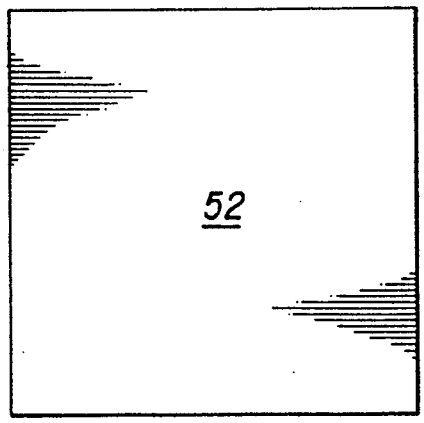
FIG. 9 is a plan view of one of the arc plates used in the structure of FIG. 8.

FIG. 9 shows that the metal plates 52 are rectangular in cross-section, i.e., no space for the moveable contact arm 12 to traverse need be provided. The metal plates 52 are easily installed in the circuit breaker 51 by sliding them into slots in the base or cover (not shown) of the circuit breaker housing 16. Preferably, the metal plates 52 cooperate with the circuit breaker 51 housing 16 to seal off the gas path from the moveable contact arm 12 over the top of the plates 52.

The principal advantage of the circuit breaker 51 shown in FIG. 8 over that shown in FIG. 1 is that the arc stack serves as both a physical and electrical shield against unintended lug 18 strikes. Additional elements such as barriers, insulators, and deflectors are not required since the electric arc 30 is prevented by the arc stack itself from passing through the vent holes 32 to the lug 18.

While the invention has been described in terms of its embodiments, those skilled in the art will recognize that the invention can be practiced with modification within the spirit and scope of the appended claims.

Having thus described my invention, what I claim as new and desire to secure my Letters Patent us as follows:

1. An electric circuit breaker, comprising, a housing having an interior and an exterior, said housing having a means to allow gas to pass from said interior to said exterior;

a stationary contact and a moveable contact, each of which is positioned within said interior of said housing, said moveable contact being capable of moving along a path into and out of electrical connection with said stationary contact;

a lug positioned at said exterior of said housing said lug being electrically connected to said stationary contact by a conductive path; and an arc stack comprised of a plurality of parallel, spaced apart, metal plates, said arc stack being positioned within said interior of said housing between said stationary contact and said lug, each of said plurality of parallel, spaced apart, metal plates having length, width and thickness dimensions wherein said length and width dimensions are each larger than said thickness dimension, each of said plurality of spaced apart, metal plates being positioned with its length and width dimensions in a plane generally parallel to said path travelled by said movable contact and with its thickness dimension generally perpendicular to said path travelled by said movable contact.

2. An electric circuit breaker as recited in claim 1 further comprising a contact arm positioned within said interior of said housing, said moveable contact being positioned on a first point on said contact arm, said contact arm being pivotable at a second point on said contact arm spaced away from said first point, whereby said moveable contact moves along said path into and out of electrical connection with said stationary contact by pivoting said contact arm.

3. An electric circuit breaker as recited in claim 2 wherein said contact arm is fabricated to have reduced mass and electrical conductivity while maintaining strength, said contact arm defining a volume with length and area dimensions where at least one cavity occupies part of said area dimension of said contact arm and extends a full distance of said length dimension of said contact arm.

4. An electric circuit breaker as recited in claim 3 wherein said contact arm has I-beam construction.

5. An electric circuit breaker as recited in claim 3 where said contact arm has hollow cylinder construction.

6. An electric circuit breaker as recited in claim 3 wherein said contact arm has hollow polygonal cylinder construction.

7. An electric circuit breaker as recited in claim 1 wherein said conductive path connecting said lug and said stationary contact has a means for providing a current blow off loop.

8. In a circuit breaker having stationary and movable contacts which make and break electrical connections by said moveable contact being movable on a path into and out of electrical engagement with said stationary contact, a housing for said stationary and moveable contacts which has a means for venting gas pressure created inside said housing during making and breaking said electrical connections, a lug positioned external to said housing for connection with an external circuit, a conductive path connecting said lug and said stationary contact, and an arc stack positioned adjacent said path travelled by said movable contact for dissipating arcing, the improvement comprising:

a contact arm on which said movable contact is positioned, said contact arm being fabricated to have reduced mass and electrical conductivity while maintaining strength, said contact arm defining a volume with length and area dimensions where at least one cavity occupies part of said area dimension of said contact arm and extends a full distance of said length dimensions of said contact arm.

9. An electric circuit breaker as recited in claim 8 wherein said contact arm has I-beam construction.

10. An electric circuit breaker as recited in claim 8 wherein said contact arm has hollow cylinder construction.

11. An electric circuit breaker as recited in claim 8 wherein said contact arm has hollow polygonal cylinder construction.

* * * * *